US007013214B2

(12) United States Patent
Ohsaki

(10) Patent No.: US 7,013,214 B2
(45) Date of Patent: Mar. 14, 2006

(54) AIR-FUEL RATIO FEEDBACK CONTROL APPARATUS AND METHOD FOR INTERNAL COMBUSTION ENGINE

(75) Inventor: Masanobu Ohsaki, Atsugi (JP)

(73) Assignee: Hitachi, Ltd., Tokyo-to (JP)

( * ) Notice: Subject to any disclaimer, the term of this patent is extended or adjusted under 35 U.S.C. 154(b) by 63 days.

(21) Appl. No.: 10/739,033

(22) Filed: Dec. 19, 2003

(65) Prior Publication Data

US 2005/0072410 A1 Apr. 7, 2005

(30) Foreign Application Priority Data

Dec. 25, 2002 (JP) ..... 2002-374855

(51) Int. Cl.
*G06G 7/70* (2006.01)

(52) U.S. Cl. ..... 701/114; 123/688; 73/118.1

(58) Field of Classification Search ..... 701/114; 123/688; 73/118.1
See application file for complete search history.

(56) References Cited

U.S. PATENT DOCUMENTS 5,758,632 A * 6/1998 Yamashita et al. ..... 123/688
6,094,975 A * 8/2000 Hasegawa et al. ..... 73/118.1

FOREIGN PATENT DOCUMENTS

JP 11-264340 A 9/1999

* cited by examiner

*Primary Examiner*—Tony M. Argenbright
*Assistant Examiner*—Johnny H. Hoang
(74) *Attorney, Agent, or Firm*—Foley & Lardner LLP

(57) ABSTRACT

In a diagnosing process in which a target air-fuel ratio in an air-fuel ratio feedback control is forcibly changed, and based on a response time of a detection signal from an air-fuel ratio sensor to the change, a response characteristic of the air-fuel ratio sensor is diagnosed. When the diagnosis is finished, an air-fuel ratio feedback control signal is returned stepwise to a value immediately before the starting of diagnosis.

20 Claims, 5 Drawing Sheets

AIR-FUEL RATIO FEEDBACK CONTROL APPARATUS AND METHOD FOR INTERNAL COMBUSTION ENGINE

BACKGROUND

The present invention relates to a technique for diagnosing a response characteristic of an air-fuel ratio sensor, while feedback controlling an air-fuel ratio based on a detection result of the air-fuel ratio sensor.

Japanese Unexamined Patent Publication No. 11-264340 discloses system in which a target air-fuel ratio is forcibly changed during an air-fuel ratio feedback control. Based on a change in output of an air-fuel ratio sensor to the change in the target air-fuel ratio, a response deterioration of the air-fuel ratio sensor is diagnosed. In this conventional diagnosis process, as the target air-fuel ratio is forcibly changed and as a feedback gain is increased during the diagnosis, the target air-fuel ratio may greatly deviate from a primary target air-fuel ratio at the time when the diagnosis is finished.

When the diagnosis is finished, however the feedback gain is returned to a normal feedback gain and, therefore, it takes time to return the target air-fuel ratio to the primary target air-fuel ratio, thereby resulting in the deterioration in exhaust performance during this time. If the feedback gain is maintained high even immediately after the diagnosis is finished, although the target air-fuel ratio can be returned rapidly up to the vicinity of the primary target air-fuel ratio, an errant overshoot of air-fuel ratio may be caused.

SUMMARY

The present invention has been accomplished in view of the aforementioned problem. An object of the present invention is to avoid a deterioration of exhaust performance immediately after diagnosis is finished (in a diagnosis control performed by forcibly changing a target air-fuel ratio in an air-fuel ratio feedback control).

To achieve the aforementioned object, the present invention is constituted so that a value of an air-fuel ratio feedback control signal immediately before starting the diagnosis is stored. At the time when the diagnosis is finished, the air-fuel ratio feedback control signal is reset to the stored value.

Other objects and features of this invention will become apparent from the following description with reference to the accompanying drawings.

DETAILED DESCRIPTION

Figure 1:
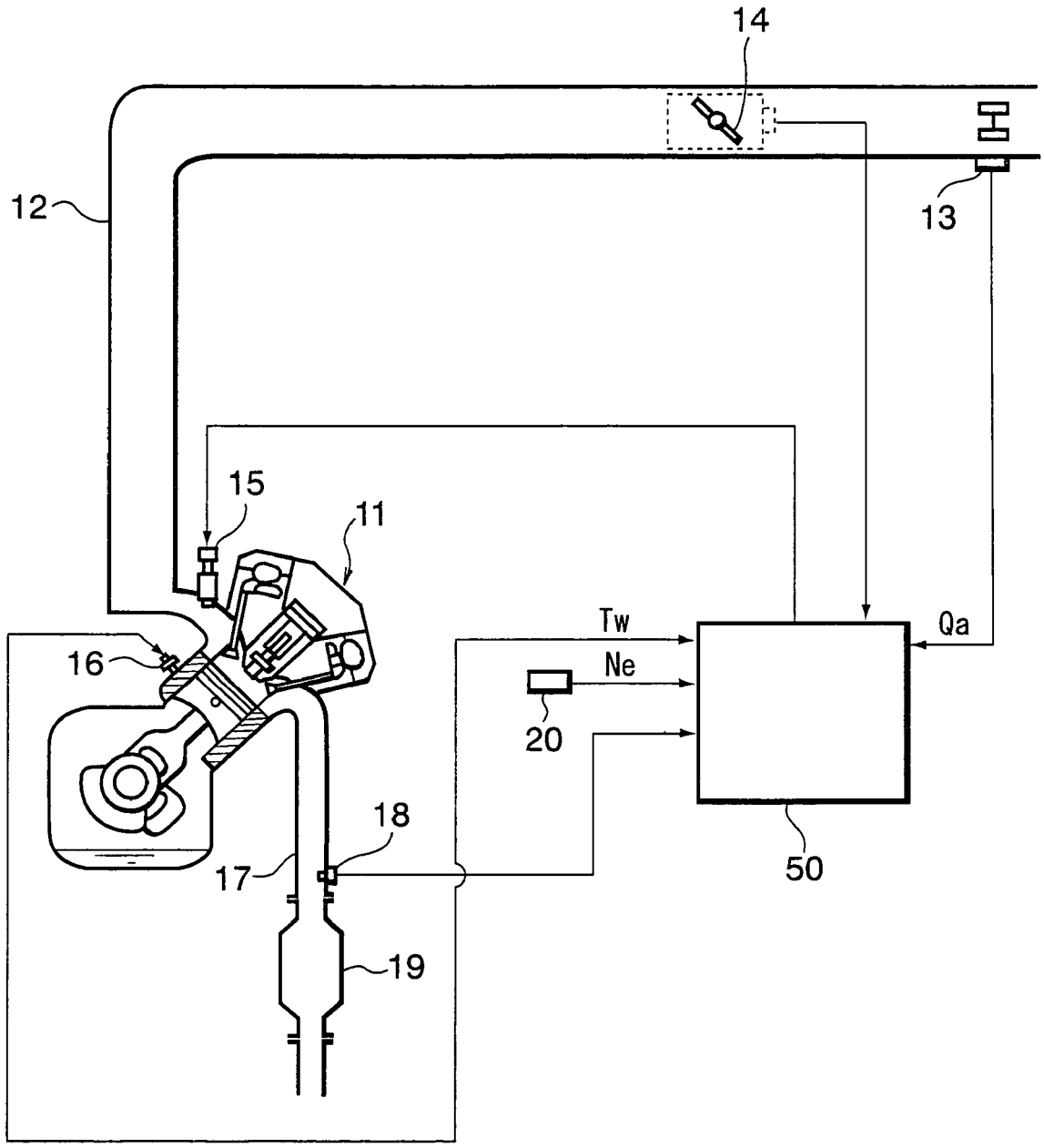
FIG. 1 is a diagram showing a system configuration of an internal combustion engine according to an embodiment of the present invention.

FIG. 1 depicts, among other things, an internal combustion engine 11 having an intake pipe 12 and an exhaust pipe

17. Disposed in the intake pipe 12 are: (a) air flow meter 13 detecting an intake air flow amount Qa; and (b) an intake choke valve 14 linked to an accelerator pedal to control the intake air flow amount Qa.

In a manifold portion downstream of intake choke valve 14, an electromagnetic type fuel injection valve 15 is disposed for each cylinder. The injection valve 15, which is opened by a drive pulse signal output from a control unit 50, injects fuel adjusted to a predetermined pressure.

Further, there is provided a water temperature sensor 16 detecting a cooling water temperature Tw in a cooling jacket of engine 11. On the other hand, an air-fuel ratio sensor 18 detecting an air-fuel ratio of a combusted mixture is disposed in the vicinity of the junction of exhaust pipe 17. The air-fuel ratio is detected based on an oxygen concentration in the exhaust gas.

Figure 4:
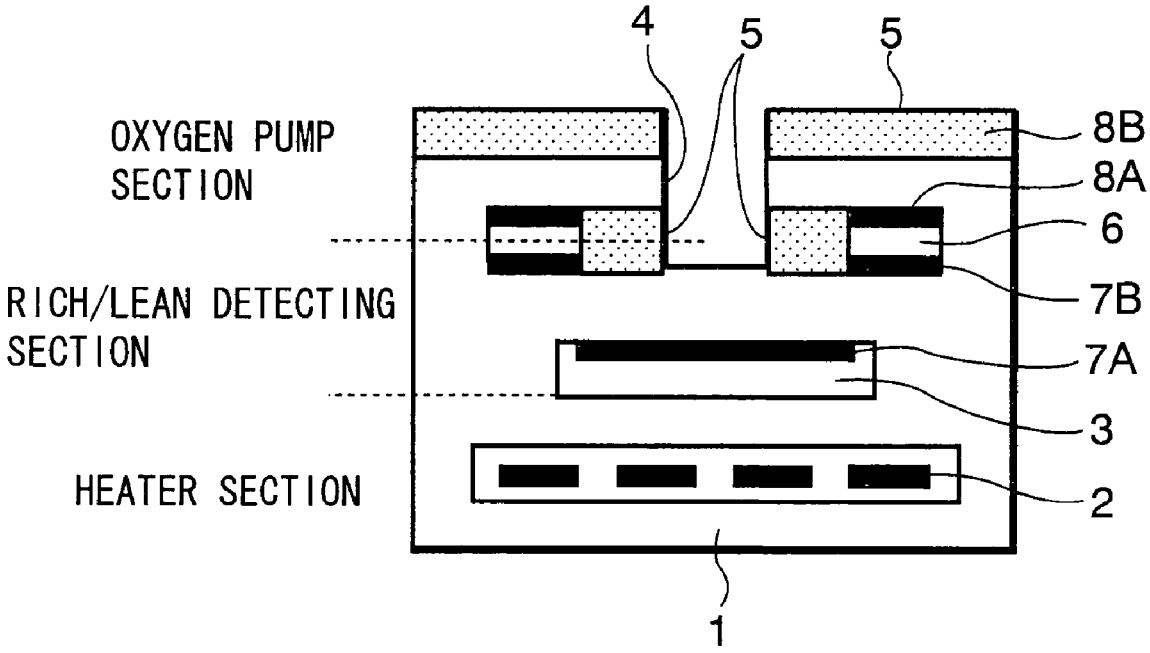
FIG. 4 is a structural diagram of the air-fuel ratio sensor in the embodiment of FIG. 1.

In exhaust pipe 17, a three-way catalyst 19 is disposed on the downstream side of the air-fuel ratio sensor 18. The three-way catalyst 19 has a function of purifying the exhaust gas, with high efficiency, when the air-fuel ratio is in the vicinity of a stoichiometric air-fuel ratio. The exhaust gas is purified by simultaneously oxidizing CO and HC and reducing NOx. The structure of the air-fuel ratio sensor 18 and the theory of detecting the air-fuel ratio will now be described with respect to FIG. 4, which shows the structure of the air-fuel ratio sensor 18.

A body 1 of the air-fuel ratio sensor 18, which is formed of zirconia $Zr_2O_3$ having, for example, oxygen ion conductivity, is disposed with a heater 2. Further, the body 1 is disposed with an atmosphere inlet 3 communicating with the atmosphere and also a gas diffusion layer 6 to which the engine exhaust gas is introduced via a gas inlet 4 and a protective layer 5. Moreover, a sensing electrode 7A is disposed on an atmosphere inlet 3 side and a sensing electrode 7B is disposed on a gas diffusion layer 6 side. Sensing electrode 7A and sensing electrode 7B face each other with the zirconia $Zr_2O_3$ therebetween. Furthermore, a pump electrode 8A is disposed on the gas diffusion layer 6 side, and a pump electrode 8B facing pump electrode 8A is disposed on a peripheral side of body 1.

A voltage according to a ratio between an oxygen concentration (oxygen partial pressure) in the gas diffusion layer 6 and an oxygen ion concentration in the atmosphere, is generated between sensing electrodes 7A and 7B. Accordingly, whether the air-fuel ratio in the gas diffusion layer 6 is richer or leaner than the stoichiometric air-fuel ratio is detected based on the voltage.

On the other hand, a voltage is applied between the pump electrodes 8A and 8B according to the voltage generated between the sensing electrodes 7A and 7B, namely, according to the richness or leanness of the air-fuel ratio in the gas diffusion layer 6. If a predetermined voltage is applied between the pump electrodes 8A and 8B, according to this, oxygen ions in the gas diffusion layer 6 migrate such that a current flows between the pump electrodes 8A and 8B.

When the predetermined voltage is applied between the pump electrodes 8A and 8B, a current value (limiting current) Ip flowing between the pump electrodes 8A and 8B is influenced by an oxygen ion concentration in the exhaust gas and, therefore, it is possible to detect the air-fuel ratio by detecting the current value (limiting current) Ip. Namely, as shown in table (A) of FIG. 5, there is a fixed correlation between the voltage/current between the pump electrodes and the air-fuel ratio. Accordingly, an application direction of the voltage between the pump electrodes 8A and 8B is inverted based on the rich/lean output from the sensing electrodes 7A and 7B, so that the air-fuel ratio can be detected in both the lean air-fuel ratio region and the rich air-fuel ratio region based on the current value (limiting current) Ip flowing between the pump electrodes 8A and 8B.

Figure 5:
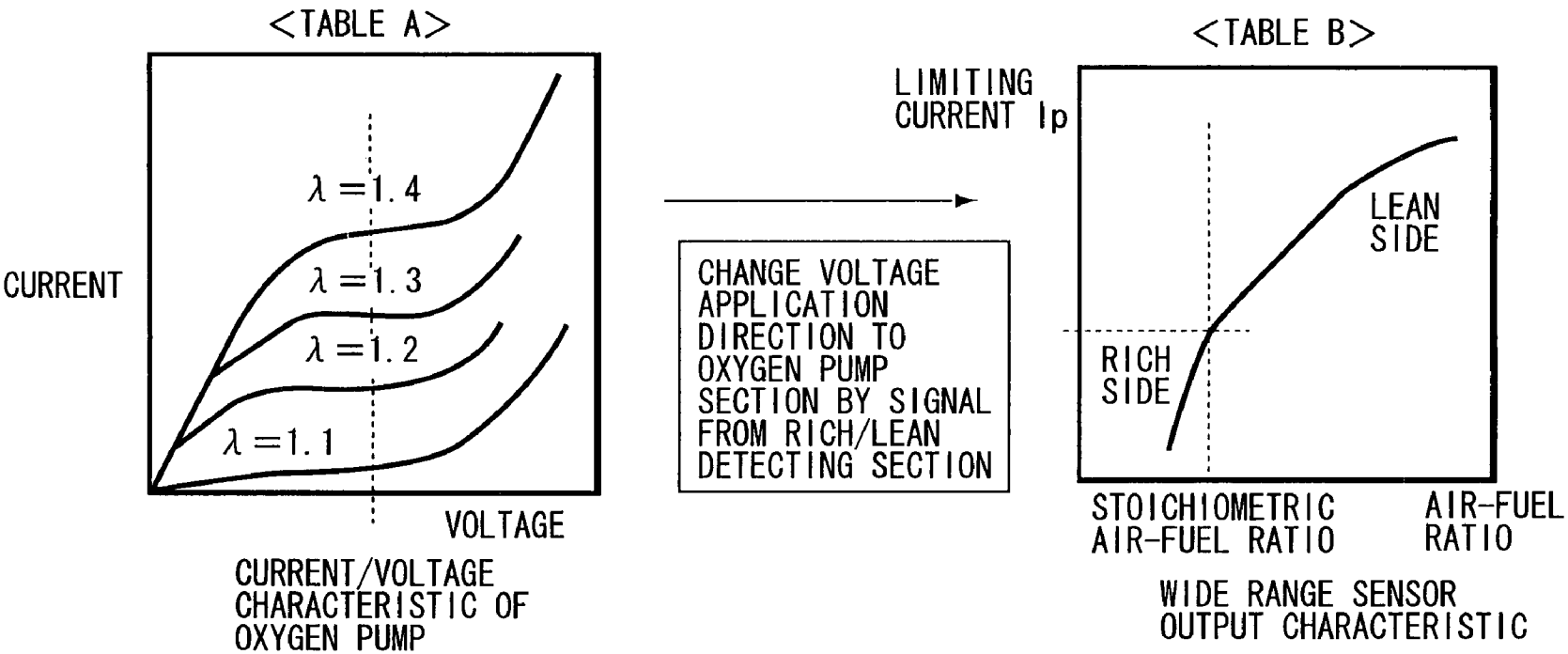
FIG. 5 is a diagram showing the detection theory of the air-fuel ratio sensor in the embodiment of FIG. 1.

According to the detection theory previously described, by referring to a table (B) of FIG. 5 (based on the current value Ip flowing between the pump electrodes 8A and 8B), it is possible to detect the air-fuel ratio over a wide range.

With respect to FIG. 1, the engine 11 is provided with a crank angle sensor 20 detecting an angle of a crankshaft. The control unit 50, which calculates an engine rotation speed Ne based on a detection signal from the crank angle sensor 20, incorporates therein a microcomputer comprising CPU, ROM, RAM, A/D converter, input/output interface and the like.

The control unit 50 receives detection signals from the air-fuel ratio sensor 18, the air flow meter 13, the water temperature sensor 16, the crank angle sensor 20 and the like, to control a fuel injection quantity of fuel injection valve 15 in the following manner. The control unit 50 calculates a basic fuel injection pulse width Tp based on the intake air flow amount Qa detected by the air flow meter 13 and the engine rotation speed Ne obtained by the detection signal from the crank angle sensor 20. Specifically, the basic fuel injection pulse width Tp is defined as follows:

$$Tp=k\times Qa/Ne(k\text{:constant})$$

In addition, the control unit 50 calculates: (a) a correction coefficient Kw for increasingly correcting the fuel at the low temperature time; (b) a correction coefficient Kas for increasingly correcting the fuel at and after the starting of engine operation; (c) an air-fuel ratio feedback correction coefficient (i.e. an air-fuel ratio feedback control signal) LAMBDA; (d) a correction portion Ts depending on a battery voltage; and (e) a target equivalence ratio Z corresponding to a target air-fuel ratio. Subsequently, the control unit 50 calculates a final fuel injection pulse width Ti as follows:

$$Ti=Tp\times(1+Kw+Kas+\ldots)\times LAMBDA\times Z+Ts$$

A drive pulse signal of fuel injection pulse width Ti is sent to the fuel injection valve 15, so that fuel, which is in an amount proportional to an effective injection pulse width Te, is injected. The effective injection pulse width Te is obtained by subtracting the correction portion Ts from the fuel injection pulse width Ti.

The air-fuel ratio feedback correction coefficient LAMBDA, which is the air-fuel ratio feedback control signal for bringing an actual air-fuel ratio detected by the air-fuel ratio sensor 18 into the target air-fuel ratio, is set by a proportional integral and derivative control based on a deviation between the actual air-fuel ratio detected by the air-fuel ratio sensor 18 and the target air-fuel ratio.

In an air-fuel ratio feedback control using the air-fuel ratio sensor 18, as the air-fuel ratio is stable in the vicinity of the target air-fuel ratio, the adsorption or desorption of oxygen molecules to or from the catalyst surface is not performed sufficiently. As a result, the transformation efficiency in the catalyst may be reduced. Therefore, in the air-fuel ratio feedback control using the air-fuel ratio sensor 18, the adsorption or desorption of oxygen molecules to or from the catalyst surface may be promoted by slightly shifting the target air-fuel ratio around a requested air-fuel ratio. Further, the control unit 50 has a function for diagnosing a response characteristic of the air-fuel ratio sensor 18.

The following is a description of the diagnosis process of the response characteristic. In the diagnosis process of the air-fuel ratio sensor 18, when the air-fuel ratio feedback control is being performed, the target air-fuel ratio is forcibly changed, to diagnose the reduction of response characteristic of the air-fuel ratio sensor 18 based on a change in detection signal from the air-fuel ratio sensor 18 to the change in the target air-fuel ratio.

To be specific, the reduction of the response characteristic of the air-fuel ratio sensor 18 is diagnosed depending on: (a) a required time until a detection value of the air-fuel ratio sensor 18 converges in the target air-fuel ratio after the target air-fuel ratio is changed; or (b) a required time until the detection value of the air-fuel ratio sensor 18 passes over the target air-fuel ratio (or a predetermined air-fuel ratio) after the target air-fuel ratio is changed. Further, it is also possible to diagnose a response deterioration of the air-fuel ratio sensor 18 by measuring a change speed of the detection signal from the air-fuel ratio sensor 18 after the target air-fuel ratio is changed. Note, during the diagnosis of the air-fuel ratio sensor 18, a value of feedback gain is made larger than that in the normal air-fuel ratio feedback control time. As a result, timewise variations until the output of air-fuel ratio sensor 18 converges (in the post-switched target air-fuel ratio) are reduced as few as much as possible, thereby improving the accuracy of the diagnosis.

Figure 2:
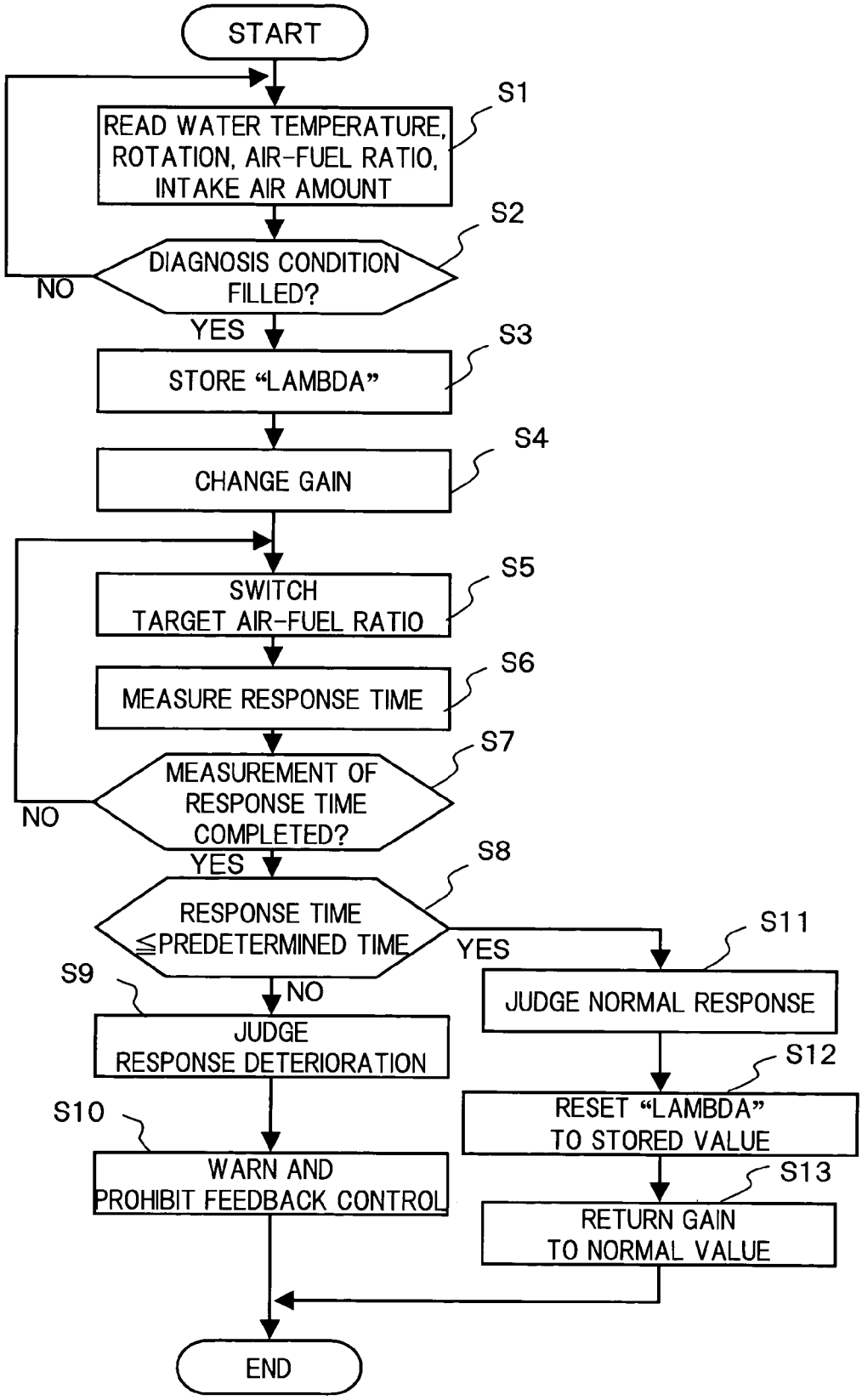
FIG. 2 is a flowchart showing the diagnosing process of an air-fuel ratio sensor in the embodiment of FIG. 1.

The diagnosis process of the air-fuel ratio sensor 18 performed by the control unit 50 will be described in detail in accordance with a flowchart shown in FIG. 2.

In step S1, the engine cooling water temperature Tw, the engine rotation speed Ne, an output VAF of the air-fuel ratio sensor 18, and the intake air flow amount Qa are read.

In step S2, it is judged whether a diagnosis permission condition is filled. As diagnosis permission conditions, for example, the following four conditions are judged: (1) whether a predetermined time has elapsed after the starting of engine operation; (2) whether the air-fuel ratio sensor 18 is activated; (3) whether the air-fuel ratio is being feedback controlled, and (4) whether the catalyst 19 is activated. If the previous four conditions (1) through (4) are filled, control proceeds to step S3.

In step S3, the air-fuel ratio feedback correction coefficient LAMBDA at that time (i.e. the air-fuel ratio feedback control signal in just immediately before the starting of diagnosis) is stored.

In step S4, the value of the feedback gain (proportional gain, integral gain and derivative gain) used for the diagnosis is switched to be larger than a normal value. Note, it is unnecessary to make all of the proportional gain, integral gain and derivative gain larger. Moreover at least one of the three constants may be made larger.

In step S5, the target air-fuel ratio is periodically changed in stepwise.

Figure 3:
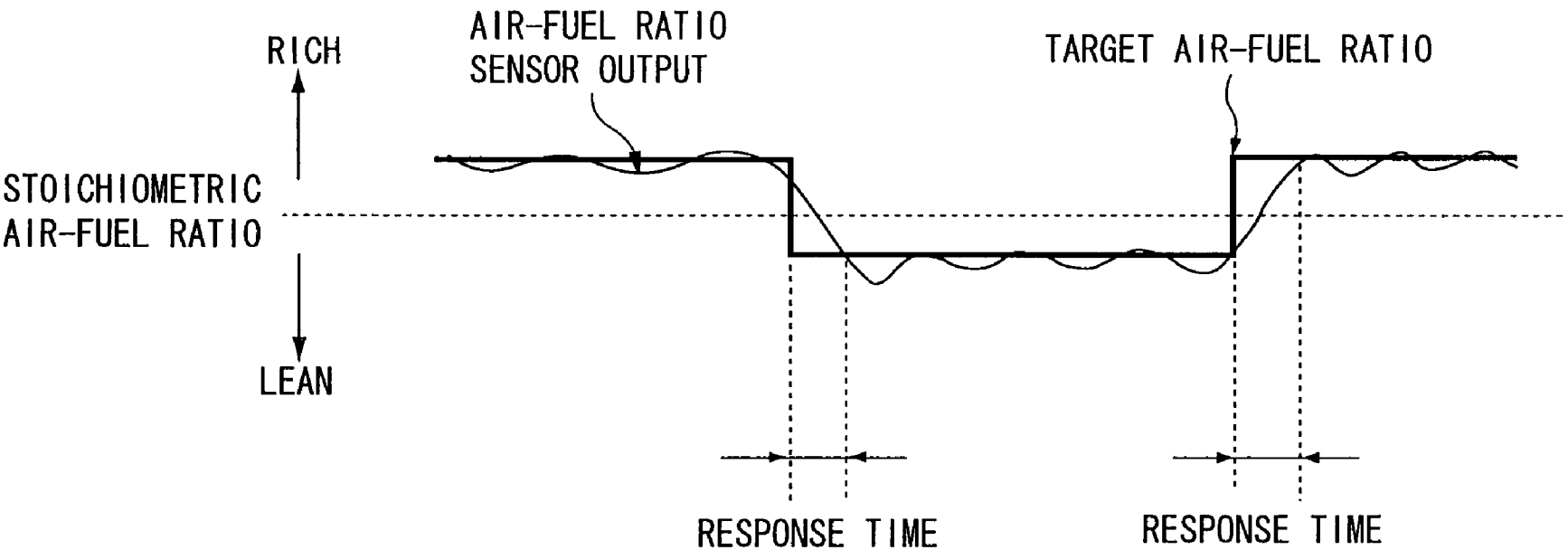
FIG. 3 is a time chart showing a change in detection signal from the air-fuel ratio sensor with the switching of target air-fuel ratio in embodiment of FIG. 1.

In step S6, a response time of the output value of the air-fuel ratio sensor 18 at the time when the target air-fuel ratio is inverted from rich to lean, is measured. Further, the response time of the output value of the air-fuel ratio sensor 18 at the time when the target air-fuel ratio is inverted from lean to rich, is also measured (refer to FIG. 3). The response time is: (a) a required time until the detection value of the air-fuel ratio sensor 18 converges (in the post-switched target air-fuel ratio after the target air-fuel ratio is changed stepwise); or (b) a required time until the detection value of the air-fuel ratio sensor 18 passes over the target air-fuel ratio (or the predetermined air-fuel ratio) after the target air-fuel ratio is changed stepwise.

In step S7, it is judged whether or not the measurement of the response time is completed. If the measurement is completed, control proceeds to step S8.

In step S8, the judgment of the response time is performed. For example, it is judged whether either of the following is less than or equal to the predetermined time: (a) the time until the detection value of the air-fuel ratio sensor 18 passes over the target air-fuel ratio from when the target air-fuel ratio is inverted from lean to rich (refer to FIG. 3); or (b) the time until the detection value of the air-fuel ratio sensor 18 passes over the target air-fuel ratio from when the target air-fuel ratio is inverted from rich to lean. Then, if the response time exceeds the predetermined time, control proceeds to step S9.

In step S9, it is judged that the response characteristic of the air-fuel ratio sensor 18 is deteriorated. When it is judged in step S9 that the response characteristic of the air-fuel ratio sensor 18 is deteriorated, control proceeds to step S10.

In step S10: (a) an abnormality of the air-fuel ratio sensor 18 is notified to a driver by activating a warning signal light and the like to urge the driver to perform repair; and (b) the air-fuel ratio feedback control based on the detection result of the air-fuel ratio sensor 18 is prohibited. On the other hand, if the response time is equal to or less than the predetermined time, then control proceeds to step S11.

In step S11, it is judged that the response characteristic of the air-fuel ratio sensor 18 is normal. When it is judged in step S11 that the response characteristic of the air-fuel ratio sensor 18 is normal, control proceeds to step S12.

In step S12, the air-fuel ratio feedback correction coefficient LAMBDA is reset to the value immediately before the starting of diagnosis, which reset value was stored in step S3.

In step S13, the air-fuel ratio feedback gain and the target air-fuel ratio are returned to the normal values, thereby resuming the normal air-fuel ratio feedback control.

As previously described at the time when the diagnosis is finished, if the air-fuel ratio feedback correction coefficient LAMBDA is reset to the value stored immediately before the starting of diagnosis, it is possible to control the air-fuel ratio to be substantially in the vicinity of the target air-fuel ratio immediately after the finish of diagnosis. As a result, it is possible to converge rapidly the air-fuel ratio in the target air-fuel ratio without an overshoot, thereby avoiding the deterioration of exhaust performance.

For example, if the normal air-fuel ratio feedback control is resumed without resetting the air-fuel ratio feedback correction coefficient LAMBDA from that at the finish of diagnosis, the exhaust performance is deteriorated during the air-fuel ratio and is changed to a primary target air-fuel ratio. However, the value of the air-fuel ratio feedback correction coefficient LAMBDA immediately before the starting of diagnosis is estimated to be a value capable of controlling the air-fuel ratio to be in the vicinity of the target air-fuel ratio. Therefore, if the air-fuel ratio feedback correction coefficient LAMBDA is changed stepwise to such a value, the air-fuel ratio can converge rapidly in the vicinity of the target air-fuel ratio, thereby avoiding the deterioration of exhaust performance.

The contents of Japanese Patent Application No. 2002-374855 filed Dec. 25, 2002, a priority of which is claimed, are incorporated herein by reference.

While only one selected embodiment has been chosen to illustrate the present invention, it will be apparent to those skilled in the art from this disclosure that various changes and modifications can be made herein without departing from the scope of the invention as defined in the appended claims. Furthermore, the foregoing description of the embodiment according to the present invention is provided for illustration only, and not for the purpose of limiting the invention as defined in the appended claims and their equivalents.

What is claimed is:

1. An air-fuel ratio feedback control apparatus for an internal combustion engine, comprising:

an air-fuel ratio sensor disposed in an exhaust pipe of said engine, to output a detection signal of an air-fuel ratio;

a control section that receives the detection signal from said air-fuel ratio sensor, and that outputs an air-fuel ratio feedback control signal so that the air-fuel ratio detected based on the detection signal is brought into a target air-fuel ratio;

a diagnosing section that forcibly changes said target air-fuel ratio during an air-fuel ratio feedback control by said control section, that diagnoses a response characteristic of said air-fuel ratio sensor based on a change in detection signal from said air-fuel ratio sensor to the change in said target air-fuel ratio, and that outputs a signal indicating a diagnosis result;

a storing section that stores a value of the air-fuel ratio feedback control signal immediately before the starting of diagnosis by said diagnosing section; and a reset section that returns said target air-fuel ratio to a normal value when the diagnosis by said diagnosing section is finished, and that simultaneously resets said air-fuel ratio feedback control signal to said value stored in said storing section immediately before the starting of the diagnosis.

2. An air-fuel ratio feedback control apparatus for an internal combustion engine according to claim 1, further comprising:

a gain setting section that changes a value of a feedback gain in said control section to be larger than a normal value when the diagnosis is performed by said diagnosis section.

3. An air-fuel ratio feedback control apparatus for an internal combustion engine according to claim 1, wherein said diagnosis section diagnoses the response characteristic of said air-fuel ratio sensor based on a time until the detection signal from said air-fuel ratio sensor indicates a predetermined change in air-fuel ratio after said target air-fuel ratio is forcibly changed.

4. An air-fuel ratio feedback control apparatus for an internal combustion engine according to claim 1, wherein said diagnosis section diagnoses the response characteristic of said air-fuel ratio sensor based on a time of after said target air-fuel ratio is forcibly changed until the detection signal from said air-fuel ratio sensor converges in a value equivalent to the post-changed target air-fuel ratio.

5. An air-fuel ratio feedback control apparatus for an internal combustion engine according to claim 1, wherein said diagnosis section diagnoses the response characteristic of said air-fuel ratio sensor based on a time until the detection signal from said air-fuel ratio sensor passes over a value equivalent to a predetermined air-fuel ratio after said target air-fuel ratio is forcibly changed.

6. An air-fuel ratio feedback control apparatus for an internal combustion engine according to claim 1, wherein said diagnosis section diagnoses the response characteristic of said air-fuel ratio sensor based on a change speed in detection signal from said air-fuel ratio sensor after said target air-fuel ratio is forcibly changed.

7. An air-fuel ratio feedback control apparatus for an internal combustion engine according to claim 1, further comprising:

a feedback control prohibition section that prohibits the air-fuel ratio feedback control by said control section, when a signal indicating response deterioration is output from said diagnosis section.

8. An air-fuel ratio feedback control apparatus for an internal combustion engine according to claim 1, wherein said diagnosis section periodically changes said target air-fuel ratio stepwise.

9. An air-fuel ratio feedback control apparatus for an internal combustion engine, comprising:

an air-fuel ratio sensor disposed in an exhaust pipe of said engine, to output a detection signal of an air-fuel ratio;

a control section that receives the detection signal from said air-fuel ratio sensor, and that outputs an air-fuel ratio feedback control signal so that the air-fuel ratio detected based on the detection signal is brought into a target air-fuel ratio;

a diagnosing section that forcibly changes said target air-fuel ratio during an air-fuel ratio feedback control by said control section, that diagnoses a response characteristic of said air-fuel ratio sensor based on a change in detection signal from said air-fuel ratio sensor to the change in said target air-fuel ratio, and that outputs a signal indicating a diagnosis result;

a reset section that stores a value of air-fuel ratio feedback control signal immediately before the starting of diagnosis by said diagnosis section, and that resets said air-fuel ratio feedback control signal to said stored value when the diagnosis is finished; and an exhaust purification catalyst disposed downstream of said air-fuel ratio sensor in said exhaust pipe;

wherein said diagnosis section diagnoses the response characteristic of said air-fuel ratio sensor, provided that a predetermined time or above has elapsed from the starting of engine operation, that said air-fuel ratio sensor is activated, and that said exhaust purification catalyst is activated.

10. An air-fuel ratio feedback control apparatus for an internal combustion engine, comprising:

an air-fuel ratio sensor disposed in an exhaust pipe of said engine, to output a detection signal of an air-fuel ratio, the air-fuel ratio sensor includes comprising:

a gas diffusion layer to which engine exhaust gas is introduced;

a rich/lean detecting section that detects whether an air-fuel ratio in said gas diffusion layer is richer or leaner than a stoichiometric air-fuel ratio; and a pump section that is applied with a voltage based on the detection result of said rich/lean detecting section, to migrate oxygen ions in said gas diffusion layer;

a control section that receives the detection signal from said air-fuel ratio sensor, and that outputs an air-fuel ratio feedback control signal so that the air-fuel ratio detected based on the detection signal is brought into a target air-fuel ratio;

a diagnosing section that forcibly changes said target air-fuel ratio during an air-fuel ratio feedback control by said control section, that diagnoses a response characteristic of said air-fuel ratio sensor based on a change in detection signal from said air-fuel ratio sensor to the change in said target air-fuel ratio, and that outputs a signal indicating a diagnosis result; and a reset section that stores a value of air-fuel ratio feedback control signal immediately before the starting of diagnosis by said diagnosis section, and that resets said air-fuel ratio feedback control signal to said stored value when the diagnosis is finished.

11. An air-fuel ratio feedback control apparatus for an internal combustion engine, comprising:

air-fuel ratio detecting means disposed in an exhaust pipe of said engine, for outputting a detection signal of an air-fuel ratio;

control means for receiving the detection signal from said air-fuel ratio detecting means, and for outputting an air-fuel ratio feedback control signal so that the air-fuel ratio detected based on the detection signal is brought into a target air-fuel ratio;

diagnosing means for forcibly changing said target air-fuel ratio during an air-fuel ratio feedback control by said control means, for diagnosing a response characteristic of said air-fuel ratio detecting means based on a change in detection signal from said air-fuel ratio detecting means to the change in said target air-fuel ratio, and for outputting a signal indicating a diagnosis result;

storing means for storing a value of the air-fuel ratio feedback control signal immediately before the starting of diagnosis by said diagnosing means; and reset means for returning said target air-fuel ratio to a normal value when the diagnosis by said diagnosing means is finished, and for simultaneously resetting said air-fuel ratio feedback control signal to said value stored in said storing means immediately before the starting of the diagnosis.

12. An air-fuel ratio feedback control method for an internal combustion engine, comprising the steps of:

detecting an air-fuel ratio based on a detection signal from an air-fuel ratio sensor disposed in an exhaust pipe of said engine;

outputting an air-fuel ratio feedback control signal so that the air-fuel ratio detected based on the detection signal is brought into a target air-fuel ratio;

forcibly changing said target air-fuel ratio during an air-fuel ratio feedback control;

diagnosing a response characteristic of said air-fuel ratio sensor based on a change in detection signal to the change in said target air-fuel ratio;

storing a value of the air-fuel ratio feedback control signal in just immediately before the starting of diagnosis;

returning said target air-fuel ratio to a normal value when the step of diagnosis is finished; and resetting said air-fuel ratio feedback control signal to said stored value when the step of diagnosing is finished.

13. An air-fuel ratio feedback control method for an internal combustion engine according to claim 12, further comprising the step of;

changing a value of a feedback gain to be larger than a normal value when the response characteristic of said air-fuel ratio sensor is diagnosed.

14. An air-fuel ratio feedback control method for an internal combustion engine according to claim 12, wherein said step of diagnosing the response characteristic of said air-fuel ratio sensor comprises the steps of:

measuring a time until the detection signal from said air-fuel ratio sensor indicates a predetermined change in air-fuel ratio after said target air-fuel ratio is forcibly changed;

comparing said measured time with a predetermined time; and outputting a signal indicating response deterioration when said measured time exceeds the predetermined time.

15. An air-fuel ratio feedback control method for an internal combustion engine according to claim 12, wherein said step of diagnosing the response characteristic of said air-fuel ratio sensor comprises the steps of:

measuring a time of after said target air-fuel ratio is forcibly changed until the detection signal from said air-fuel ratio sensor converges in a value equivalent to the post-changed target air-fuel ratio;

comparing said measured time with a predetermined time; and outputting a signal indicating response deterioration when said measured time exceeds the predetermined time.

16. An air-fuel ratio feedback control method for an internal combustion engine according to claim 12, wherein said step of diagnosing the response characteristic of said air-fuel ratio sensor comprises the steps of:

measuring a time until the detection signal from said air-fuel ratio sensor passes over a value equivalent to a predetermined air-fuel ratio after said target air-fuel ratio is forcibly changed;

comparing said measured time with a predetermined time; and outputting a signal indicating response deterioration when said measured time exceeds the predetermined time.

17. An air-fuel ratio feedback control method for an internal combustion engine according to claim 12, wherein said step of diagnosing the response characteristic of said air-fuel ratio sensor comprises the steps of:

measuring a change speed in detection signal from said air-fuel ratio sensor after said target air-fuel ratio is forcibly changed;

comparing said measured change speed with a predetermined speed; and outputting a signal indicating response deterioration when said measured change speed is below said predetermined speed.

18. An air-fuel ratio feedback control method for an internal combustion engine according to claim 12, further comprising the steps of:

prohibiting the air-fuel ratio feedback control, when response deterioration of said air-fuel ratio sensor is diagnosed.

19. An air-fuel ratio feedback control method for an internal combustion engine according to claim 12, wherein said step of diagnosing the response characteristic of said air-fuel ratio sensor comprises the steps of:

periodically changing said target air-fuel ratio stepwise during the air-fuel ratio feedback control;

measuring a response time of said detection signal at a time when said target air-fuel ratio is changed stepwise to a richer side and at a time when said target air-fuel ratio is changed stepwise to a leaner side;

comparing said response time with a predetermined time; and outputting a signal indicating response deterioration when said response time exceeds the predetermined time.

20. An air-fuel ratio feedback control method for an internal combustion engine, comprising the steps of:

detecting an air-fuel ratio based on a detection signal from an air-fuel ratio sensor disposed in an exhaust pipe of said engine, wherein an exhaust purification catalyst is disposed downstream of said air-fuel ratio sensor in said exhaust pipe;

outputting an air-fuel ratio feedback control signal so that the air-fuel ratio detected based on the detection signal is brought into a target air-fuel ratio;

forcibly changing said target air-fuel ratio during an air-fuel ratio feedback control;

diagnosing a response characteristic of said air-fuel ratio sensor based on a change in detection signal to the change in said target air-fuel ratio, wherein said step of diagnosing the response characteristic of said air-fuel ratio sensor comprises the steps of:

judging whether or not a predetermined time or above has elapsed from the starting of engine operation;

judging whether or not said air-fuel ratio sensor is activated;

judging whether or not said exhaust purification catalyst is activated; and outputting a diagnosis permission signal when the predetermined time or above has elapsed from the starting of engine operation, and said air-fuel ratio sensor is activated, and said exhaust purification catalyst is activated;

storing a value of the air-fuel ratio feedback control signal immediately before the starting of diagnosis; and resetting said air-fuel ratio feedback control signal to said stored value when the diagnosis is finished.

* * * * *